US011794859B2

(12) United States Patent
Boyd

(10) Patent No.: US 11,794,859 B2
(45) **Date of Patent: *Oct. 24, 2023**

(54) BOAT ANCHORING SYSTEM

(71) Applicant: Action Enterprises LLC, Waterford, MI (US)

(72) Inventor: Curtis Wilson Boyd, White Lake Township, MI (US)

( * ) Notice: Subject to any disclaimer, the term of this patent is extended or adjusted under 35 U.S.C. 154(b) by 41 days.

This patent is subject to a terminal disclaimer.

(21) Appl. No.: 17/655,540

(22) Filed: Mar. 18, 2022

(65) Prior Publication Data

US 2022/0242527 A1 Aug. 4, 2022

Related U.S. Application Data

(63) Continuation of application No. 16/861,183, filed on Apr. 28, 2020, now Pat. No. 11,312,453.

(60) Provisional application No. 62/861,719, filed on Jun. 14, 2019.

(51) Int. Cl.
*B63B 21/26* (2006.01)

(52) U.S. Cl.
CPC ..... *B63B 21/26* (2013.01)

(58) Field of Classification Search
CPC ..... B63B 21/26
See application file for complete search history.

(56) References Cited

U.S. PATENT DOCUMENTS 11,312,453 B2 * 4/2022 Boyd ..... B63B 21/26

* cited by examiner

*Primary Examiner* — Stephen P Avila
(74) *Attorney, Agent, or Firm* — Richmond Firm LLC

(57) ABSTRACT

The presently disclosed boat anchoring system may include a first section and a second section. The first section may include a first proximal end region and a first distal end region. The second section may include a second proximal end region and a second distal end region. The first section may at least partially surround the second section. A geologic anchoring system may include a body section, a boring section and a lock. The body section may include a first proximal end region and a first distal end region. The boring section may include a second proximal end region and a second distal end region. The first section may least partially surround the second section. A lock may be included on the second section. The lock may engage the first section at an infinite number of contact points on the first section.

18 Claims, 9 Drawing Sheets

BOAT ANCHORING SYSTEM

RELATED APPLICATIONS

This application is a continuation patent application of and claims the benefit of U.S. patent application Ser. No. 16/861,183, filed Apr. 28, 2020, which is a non-provisional application of U.S. provisional patent application No. 62/861,719, filed on Jun. 14, 2019, the contents of each of which are hereby incorporated by reference.

FIELD

The present disclosure relates to a boat anchoring system.

BACKGROUND

This section provides background information related to the present disclosure which is not necessarily prior art.

The use of boat anchoring systems and known designs and configurations is known in the prior art. More specifically, boat anchoring systems and known designs and configurations previously devised and utilized for the purpose of anchoring boats are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,702,047 issued Oct. 27, 1987 to Stokes relates to Ground Anchors. U.S. Pat. No. 6,041,730 issued Mar. 28, 2000 to Oliverio relates to a Shallow Water Anchor. Lastly, U.S. Pat. No. 6,315,882 issued Oct. 23, 2001 to Coast relates to Apparatus for Placing Auger Type Anchors.

While these devices fulfill their respective, particular objectives and requirements, the aforementioned patents do not describe a boat anchoring system that allows securing the location of a boat in water as for fishing and the like, the securing being done in a safe, reliable and economical manner.

Therefore, it can be appreciated that there exists a continuing need for a new and improved boat anchoring system which can be used for securing the location of a boat in water, the securing being done in a safe, reliable and economical manner.

SUMMARY

This section provides a general summary of the disclosure, and is not a comprehensive disclosure of its full scope or all of its features.

Embodiments of the present inventive subject matter may include a boat anchoring system. The boat anchoring system may include a first section and a second section. The first section may include a first proximal end region and a first distal end region. The second section may include a second proximal end region and a second distal end region. The first section may at least partially surround the second section.

A drill bit may be connected to the second distal end region. A lock may be coupled and/or connected to the second section. The lock may be engageable with the first section at an infinite number of contact points on the first section.

The boat anchoring system may also include a grip at the first proximal end, a fluid inlet and a fluid outlet, each of the fluid inlet and the fluid outlet may allow fluid to enter the first section and the second section. A slot may be included in the first section. A longitudinal axis of the slot may be parallel to an elongate axis of the first section.

The grip may be transversely connected to the first section and the first section may include an internal storage compartment in which both the second section and the grip may be stored coaxially. The first section and the second section may both be tubular and elongate. The first section may surround and be coaxial with the second section. The first section and the second section may both be hollow. The lock may secure the first section to the second section such that the first section is immobile relative to the second section. The lock may engage the slot at any of the infinite number of contact points.

In an alternative embodiment, a geologic anchoring system may include a body section, a boring section and a lock. The body section may include a first proximal end region and a first distal end region. The boring section may include a second proximal end region and a second distal end region. The first section may least partially surround the second section. A lock may be included on the second section. The lock may engage the first section at an infinite number of contact points on the first section.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
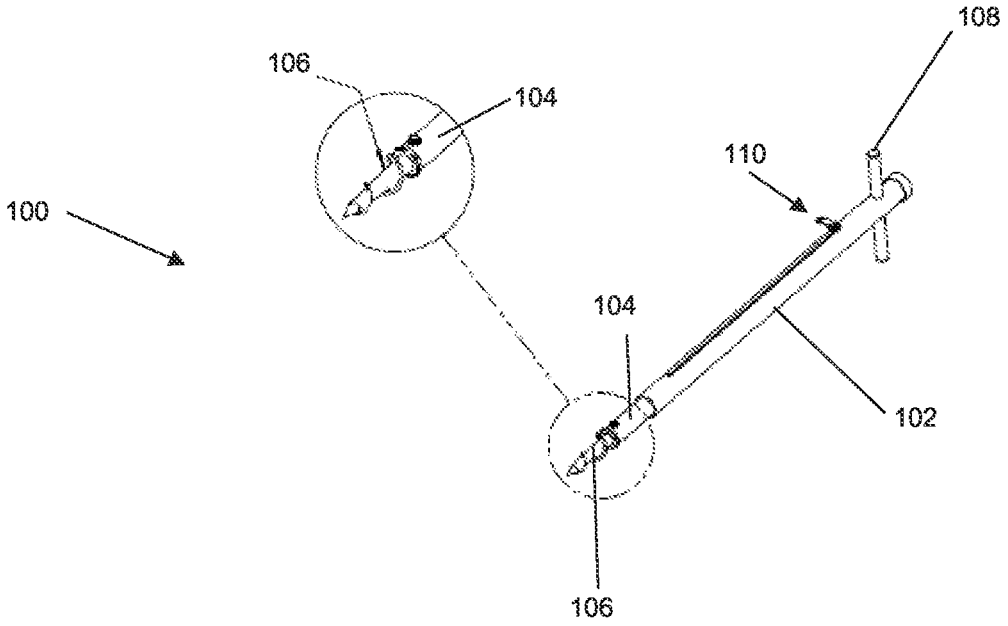
FIG. 1 illustrates an example embodiment.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

One of the problems with prior art boat anchoring systems is, for example, the inability to be infinitely adjustable, adjustability without tools and a small storage size factor. Infinite adjustability, for example, allows a boater to adjust height of the anchor relative to a boat based on a depth of water in which the boat is resting. Thus, aesthetically, the present boat anchor system reduces unnecessary and unwanted visibility of the present boat anchor. Further safety of is enhanced by the anchor projecting from the water to signal to a person to be careful when walking near the anchor. Such muted visibility is not found in prior art anchors.

In this respect, the boat anchoring system substantially departs from the conventional concepts and designs of the prior art, and in doing so provides an apparatus primarily developed for the purpose of securing the location of a boat in water, the securing being done in a safe, reliable and economical manner.

Figure 2:
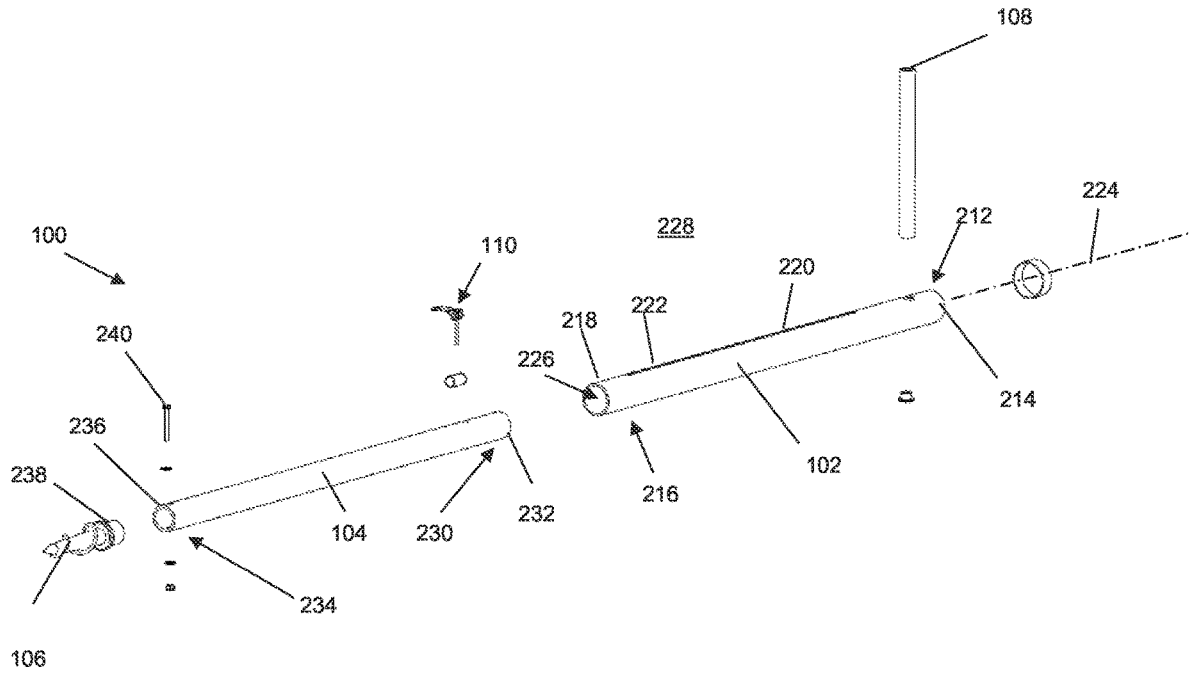
FIG. 2 illustrates an exploded view of the example embodiment.

FIGS. 1 and 2 illustrate an example embodiment of a boat anchoring system 100. As illustrated in FIG. 1, the boat anchoring system 100 may include a first section 102, a second section 104, a drill bit 106 and a handle 108, e.g., a grip and a lock system 110.

As illustrated in FIG. 2, the first section 102 may be tubular. The first section 102 may include a first proximal end region 212, which may include a first proximal end 214, and a first distal end region 216, which may include a first distal end 218. The first section 102 may also include an elongate slot 220 that has a longitudinal axis 222 that is parallel with a longitudinal axis 224 of the first section 102. The elongate slot 220 may provide fluid access between an interior 226 of the first section 102 and an exterior environment 228, the interior 226 being at least partially defined by an interior surface of the first section 102. The first section 102 may have a circular cross-section, a rectangular cross-section, an oval cross-section. a polygonal cross-section or an asymmetric cross-section.

The second section 104 may be tubular. The second section 104 may include a second proximal end region 232, which may include a second proximal end 232, and a second distal end region 234, which may include a second distal end 236.

The second section 104 may have a circular cross-section, a rectangular cross-section, an oval cross-section, a polygonal cross-section or an asymmetric cross-section. The second section 104 may also include the locking system 110, which may include a clamp, a screw, a pin, etc.

The drill bit 106 may be included at the distal end region 234 of the second section 104. The drill bit 106 may be integrally connected to the second section 104 or it may be detachably connected to the second section 104. The drill bit 106 may be attached a drill bit connection 240, e.g., through a threaded connection, a pin, and/or a key/keyway.

Figure 3A:
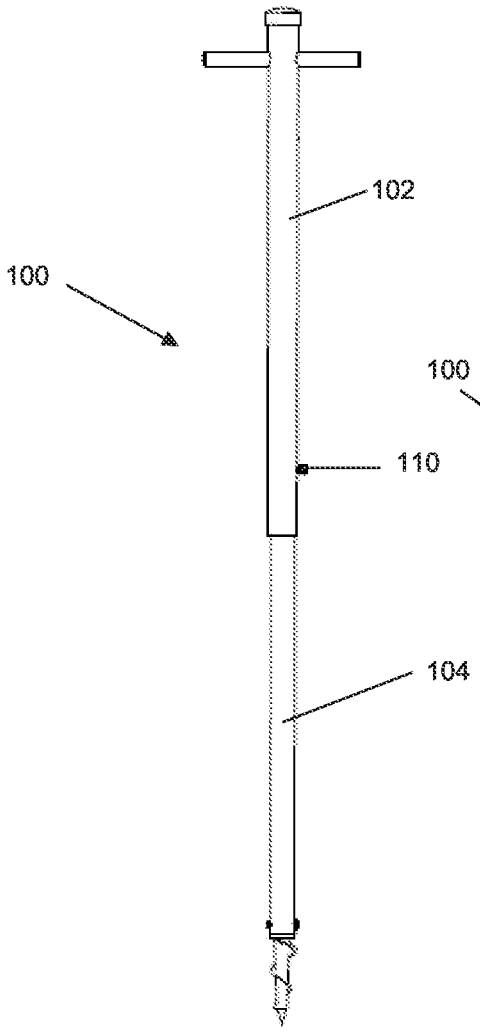
FIGS. 3A-3C illustrate the example embodiment in a plurality of configurations.
Figure 3B:
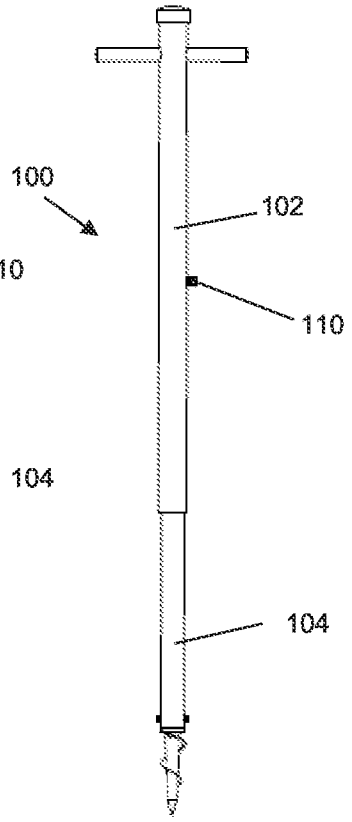
Figure 3C:
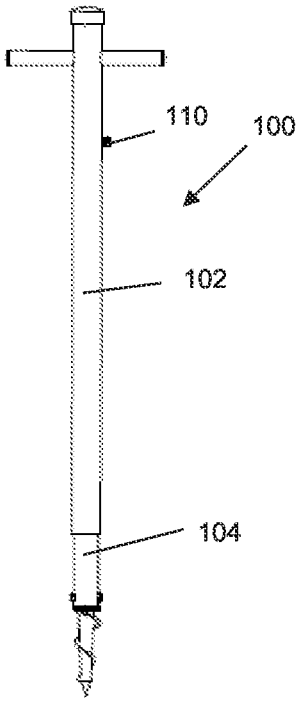

As illustrated in FIGS. 3A-3C, the first section may engage the second section 104 in a telescoping relationship. FIG. 3A illustrates the boat anchoring system 100 in an extend configuration. FIG. 3B illustrates the boat anchoring system 100 in a partially extended configuration. FIG. 3C illustrates the boat anchoring 100 system in a retracted configuration. For example, the second section 104 may include the ability to slide axially within the first section 102. The first section 102 may be locked in place to the second section 104 by an interaction between the elongate slot 220 and the lock system 110.

With further reference to FIG. 2, the drill bit 106 may be a helical drill or it may be replaced or work in conjunction with a post hole digger, a spear tip or other device capable of displacing earth. The drill bit 106 may include a key 238. The key 238 may be at a post that is insertable into the second section 104 at the distal end 236 of the second section 104 in a male/female engagement. The key 238 may have a cross-section that corresponds to a cross-section of the distal end region 234 of the second section 104. The male/female engagement may be an interference fit such that torque is transferred from the second section 104 to the drill bit 106. Additionally or alternatively, the cross-sections of the drill bit key 238 and the second section 104 may be a non-circular cross-section. Slippage may thus be prevented in the male/female engagement of the first section 102 with the second section 104.

The second section 104 may include the lock system 110. The lock system 110 is provided to lock the first section 102 to the second section 104 so that the second section 104 is immovably fixed relative to the first section 102. The lock system 110 is also provided to allow for adjustment of the second section 104 relative to the first section 102. Movement of the second section 104 relative to the first section 102 may be linear, radial or circumferential.

Figure 4A:
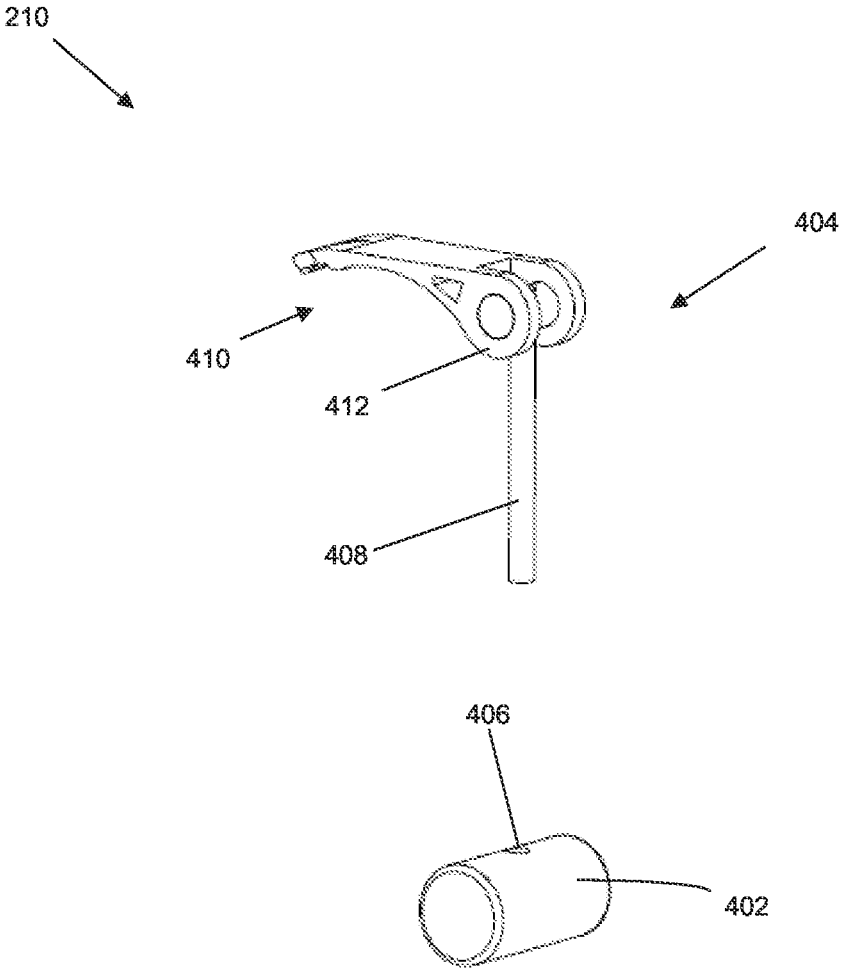
FIGS. 4A-4C illustrate components of a lock assembly.
Figure 4B:
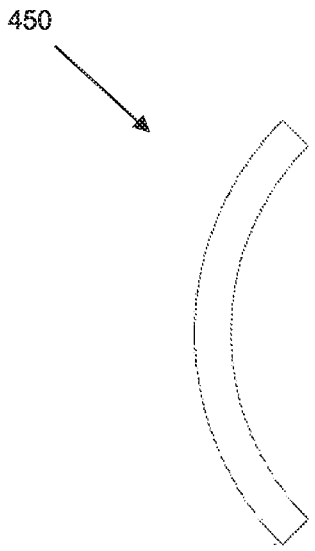
Figure 4C:
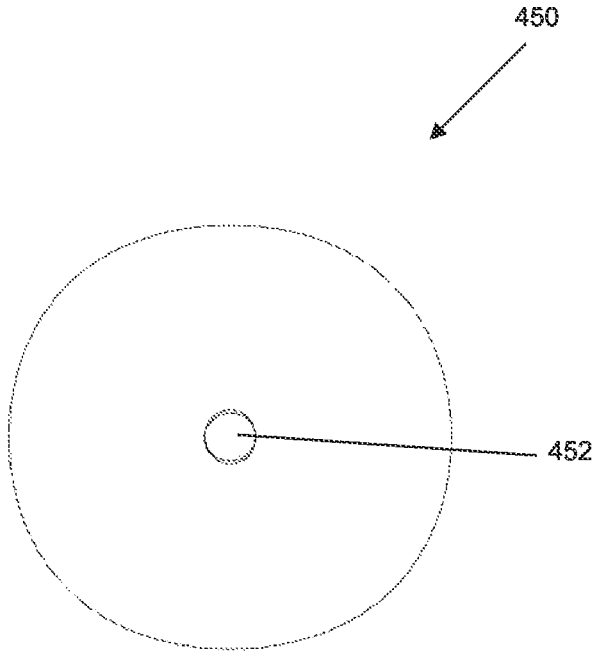

With reference to FIGS. 4A-4C, the lock system 110 may include a locking block 402 and a locking pin assembly 404. For example, the locking block 402 is illustrated in FIG. 4 and may include a cylindrical configuration. The locking block 402 may be partially circumferential, e.g., arcuate, rectangular or polygonal. The locking block 402 may include a through-hole 406 for engagement with the locking pin assembly 404.

As illustrated in FIG. 4A, the locking pin assembly 404 may include a pin 408 and a lever 410. The lever 410 may be pivotally connected to the pin 408. The lever 410 may include a cam 412 having an eccentric circular outline such that a longitudinal dimension of the cam 412 is substantially parallel with a longitudinal axis of the lever 410 and a transverse dimension of the cam 412 is parallel with a transverse dimension of the lever 410. This configuration helps the locking block 402 lock the first section 102 to the second section 104. For example, when the longitudinal axis of the lever 410 is rotated perpendicular to a longitudinal axis of the first section 102, the longitudinal dimension of the cam 412 pulls the locking block 402 toward the locking pin assembly 404 thereby clamping the first section 102 against the second section 104.

The lock 110 can be further tightened by adding a washer to an exterior surface or an interior surface of the tube 230. For example, FIG. 4B illustrates an elevation view of a washer 450 and FIG. 4C illustrates a plan view of the washer 450. The washer 450 may be shaped to correspond to the exterior surface of the tube 230 so that surface area contact between the washer and the lock 110 may be increased. Similarly, the washer 450 may be shaped to correspond to the interior surface of the tube 230 so that surface area contact between the washer and the lock 110 may be increased. The washer 450 is illustrated in FIG. 4B as having an arcuate cross-section but is not limited to a may be flat. The washer 450 may define a through-hole 452 which may be aligned with through-hole 406 in the locking block 402 when the lock assembly 110 is assembled. The through-hole 406 and the defined through-hole 452 may receive the locking pin 408 when the lock assembly is assembled.

The locking pin 408 may be fixed to the locking block 402 by a weld, a threaded fastener connection, a bolt, or other fixing systems. The locking block 402 may be contained completely within an exterior periphery of the second section 104. The locking block 402 may be slidable within the second section 104 along the longitudinal axis of the second section 104.

As the locking system 110 can engage the second section 104 at any point, the second section 104 may be locked to the first section 102 at an infinite number of positions. This contrasts with prior art boat anchors in which ratchet systems were necessary to lock a boat anchor in place. The hollow configuration of the first section 102 and the second section also allows the infinite number of positions as a pin and locking block system may be used. In previous boat anchors, at least one of the sections, e.g., an analogous first section or an analogous second section, have included at least one solid section. The hollow first section and second section may allow water into the interior of the boat anchor 100, which provides added strength against bending while still providing a light weight system.

Figure 5:
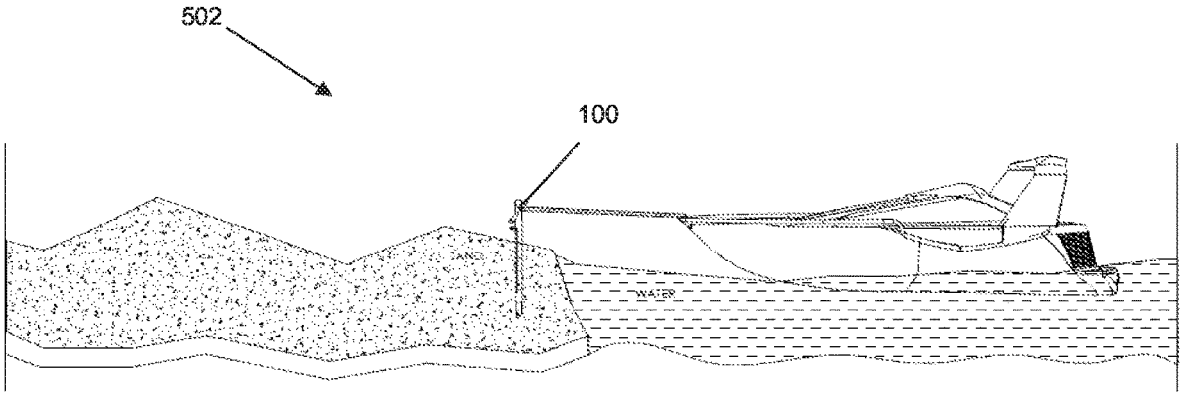
FIG. 5 illustrates the example embodiment in a first environment.
Figure 6:
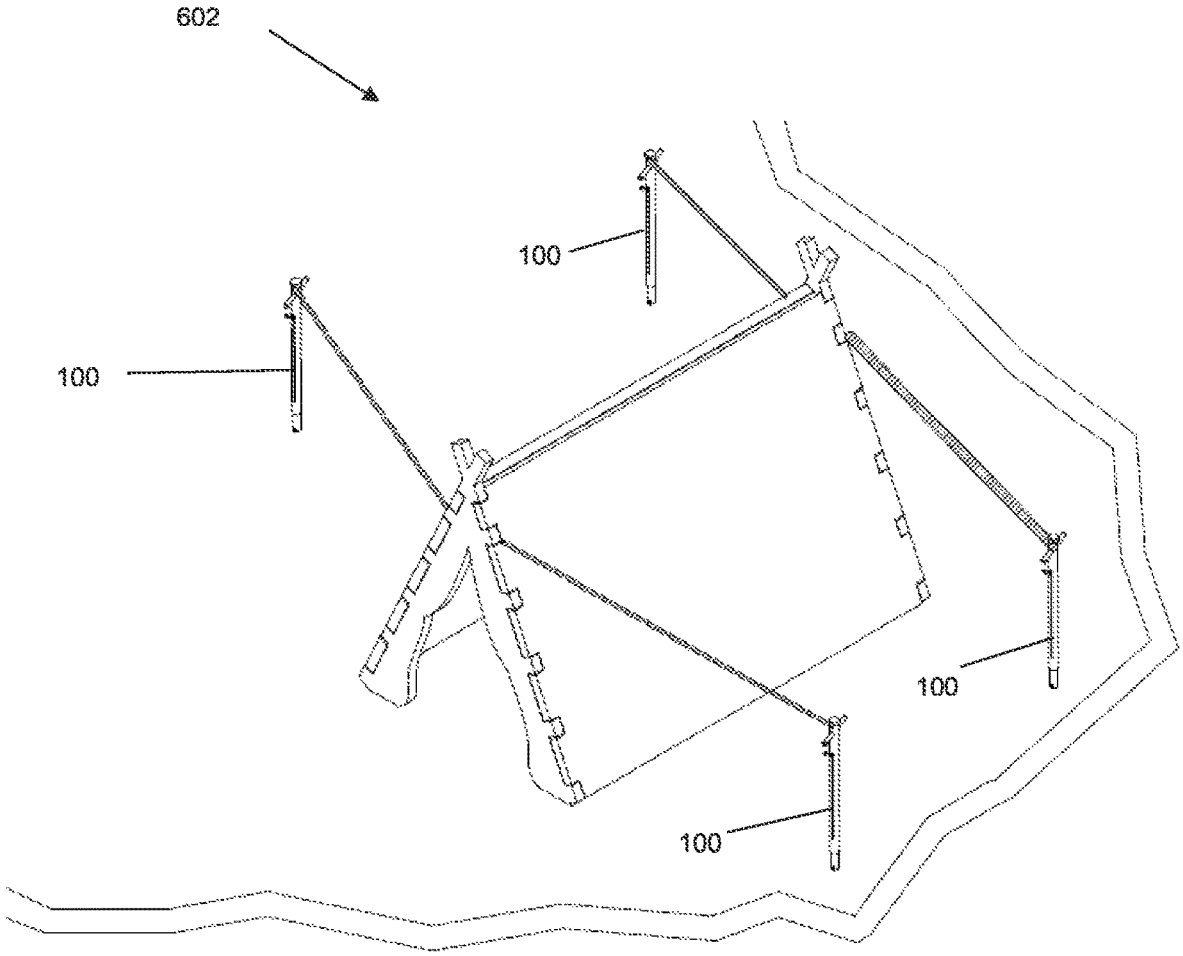
FIG. 6 illustrates the example embodiment in a second environment.
Figure 7:
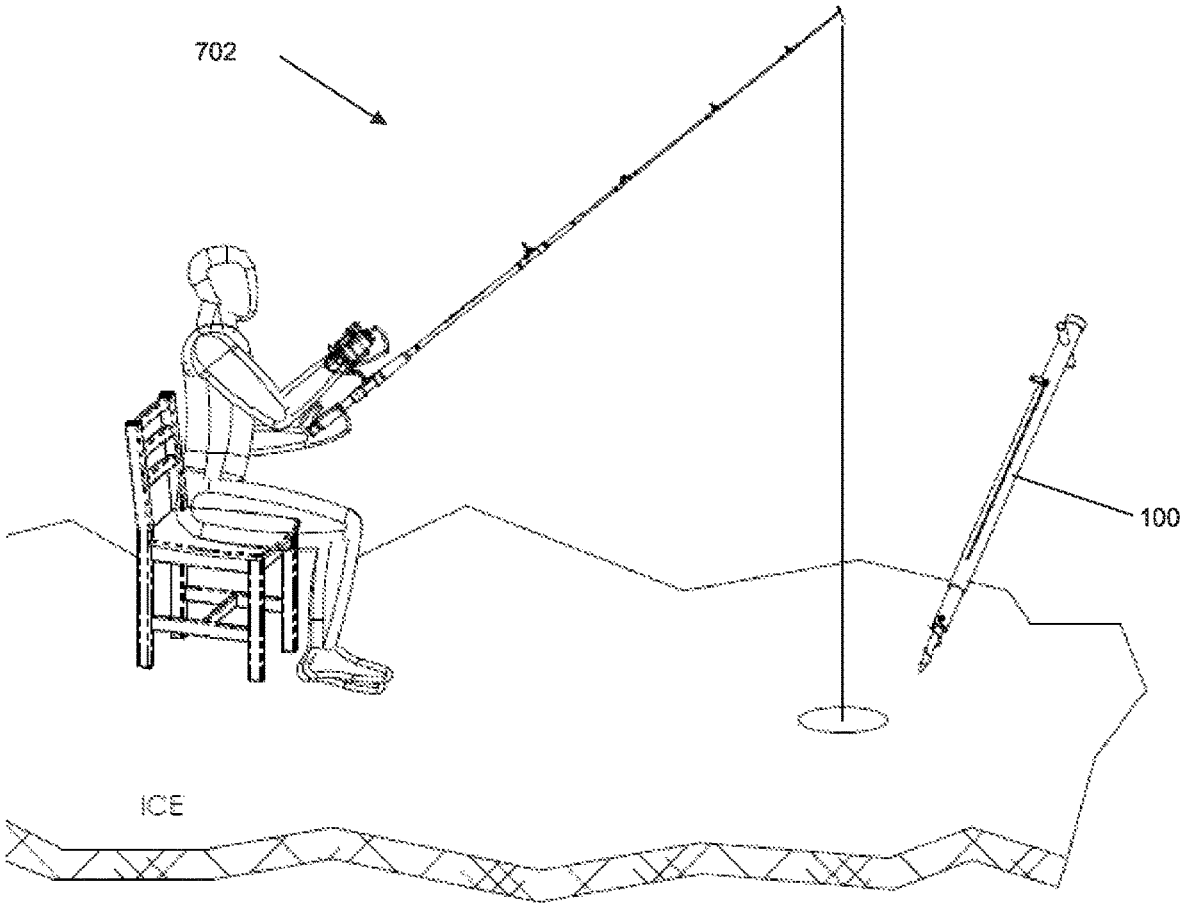
FIG. 7 illustrates the example embodiment in a third environment.

As illustrated in FIGS. 5-7, the boat anchor 100 is applicable to a variety of environments. For example, FIG. 5 illustrates the boat anchor 100 in a marine environment 502. Further, as illustrated in FIG. 6, the boat anchor 100 may be used in a camping environment 602. As illustrated in FIG. 7, the boat anchor may be used in an ice fishing environment 702. Further, implementations that are not illustrated include geologic applications such as a tie down for vehicles or pets.

Figure 8A:
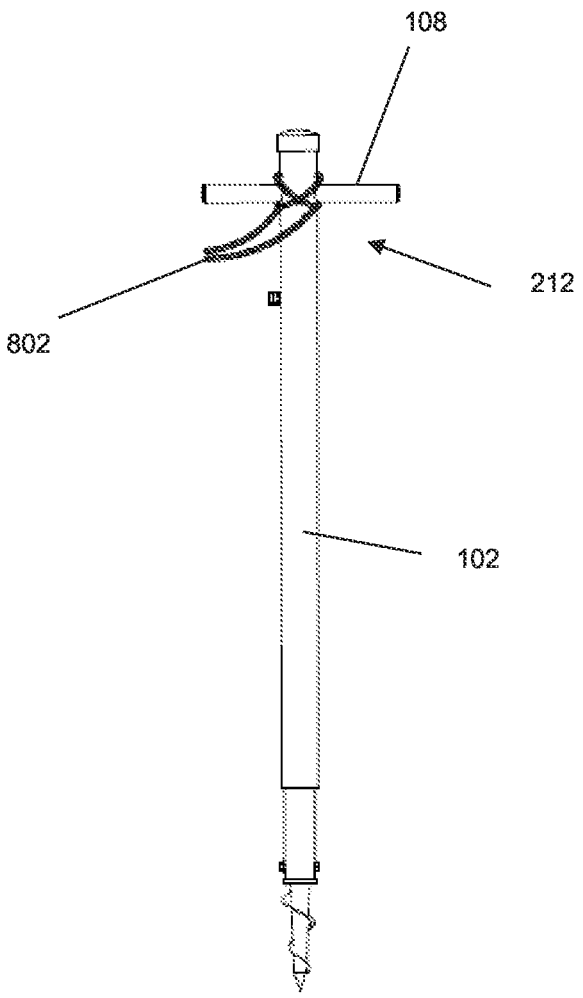
FIGS. 8A and 8B illustrate the example embodiment in respective tie-off configurations.
Figure 8B:
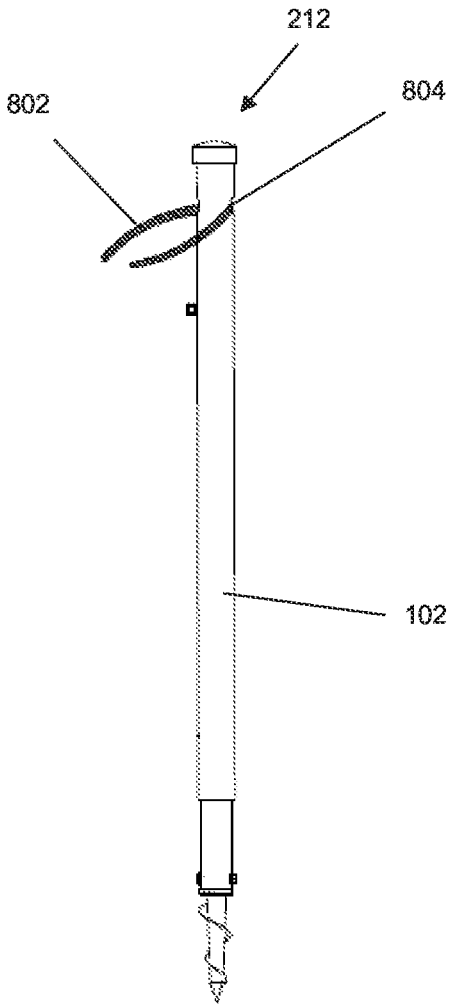

FIGS. 8A-8B, illustrate connection of an object to the anchoring system 100. As illustrated in the example embodiment of FIG. 8A, a line 802 (marine or other type of rope) may be tied to the proximal end region 212 of the first section 102. In this manner, the handle 108 and proximal end region 212 simulate a marine cleat. In the example embodiment illustrated in FIG. 8B, the proximal end region 212 of the anchoring system 100 may include a tie hole 804 through which a rope 804 or string may be inserted and tied off.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A boat anchoring system, comprising:

a first section including a first proximal end region and a first distal end region;

a second section including a second proximal end region and a second distal end region, the first section at least partially surrounding the second section;

a drill bit connected to the second distal end region;

a lock, the lock being on the second section, and being configured to lock the first section to the second section at an infinite number of contact points on the first section; and a first fluid inlet and a first fluid outlet in the first section and a second fluid inlet and a second fluid outlet in the second section, the inlets and outlets configured to allow fluid to enter the first section and the second section.

2. The boat anchoring system as recited in claim 1, wherein the lock includes a pin and a block, and wherein the block is positioned within the second section and configured to connect with the pin.

3. The boat anchoring system as recited in claim 2, wherein the block is completely within an outer periphery of the second section.

4. The boat anchoring system as recited in claim 1, further comprising:

a grip at the first proximal end region, the grip transversely connected to the first section.

5. The boat anchoring system as recited in claim 1, wherein the first section is configured to receive the second section and the grip within the first section in a substantially coaxial arrangement.

6. The boat anchoring system as recited in claim 5, wherein the first section surrounds and is coaxial with the second section.

7. The boat anchoring system as recited in claim 5, wherein the lock is configured to immobilize the first section relative to the second section.

8. The boat anchoring system as recited in claim 1, further comprising:

a slot in the first section, the slot being parallel to an elongate axis of the first section.

9. The boat anchoring system as recited in claim 8, wherein the lock is configured to engage the slot at any of the infinite number of contact points.

10. A geologic anchoring system, comprising:

a body section including a first proximal end region and a first distal end region;

a boring section including a second proximal end region and a second distal end region, the body section at least partially surrounding the boring section;

a lock on the boring section, the lock configured to engage the body section at an infinite number of contact points on the body section; and a first fluid inlet and a first fluid outlet in the body section and a second fluid inlet and a second fluid outlet in the boring section, the inlets and outlets configured to allow fluid to enter the body section and the boring section.

11. The geologic anchoring system as recited in claim 10, wherein the lock includes a pin and a block, and wherein the block is positioned within the boring section and configured to connect with the pin.

12. The geologic anchoring system as recited in claim 11, wherein the block is completely within an outer periphery of the boring section.

13. The geologic anchoring system as recited in claim 10, further comprising:

a grip at the first proximal end region, the grip being transversely connected to the first proximal end; and a borer at the second distal end region of the boring section.

14. The geologic anchoring system as recited in claim 10, wherein the body section is configured to receive the boring section and the grip within the body section in a substantially coaxial arrangement.

15. The geologic anchoring system as recited in claim 14, wherein the body section at least partially surrounds the body section.

16. The geologic anchoring system as recited in claim 14, wherein the lock is configured to immobilize the body section relative to the boring section.

17. The geologic anchoring system as recited in claim 10, further comprising:

a slot in the body section, the slot being parallel to an elongate axis of the body section.

18. The geologic anchoring system as recited in claim 17, wherein the lock is configured to engage the slot at any of the infinite number of contact points.

* * * * *